US006216644B1

(12) United States Patent
Eroglu et al.

(10) Patent No.: US 6,216,644 B1
(45) Date of Patent: Apr. 17, 2001

(54) FLOW DUCT WITH CROSS-SECTIONAL STEP

(75) Inventors: Adnan Eroglu, Untersiggenthal (CH); Franz Joos, Weilheim-Bannholz (DE); Bettina Paikert, Oberrohrdorf (CH); Cristian Oliver Paschereit, Baden (CH); Jakob J. Keller, deceased, late of Wohlen (CH), by Georg Keller, Vera Keller, legal representatives

(73) Assignee: ABB Alstrom Power (Schweiz) AG, Baden (CH)

( * ) Notice: Subject to any disclaimer, the term of this patent is extended or adjusted under 35 U.S.C. 154(b) by 0 days.

(21) Appl. No.: 09/431,179

(22) Filed: Nov. 1, 1999

(30) Foreign Application Priority Data

Nov. 6, 1998 (EP) ..... 98811112

(51) Int. Cl.[7] ..... F15D 55/04
(52) U.S. Cl. ..... 122/406.3; 138/37; 138/39
(58) Field of Search ..... 122/406.3; 138/37, 138/39; 181/264; 244/200

(56) References Cited

U.S. PATENT DOCUMENTS

| | | | | |
|---|---|---|---|---|
| 3,974,646 | | 8/1976 | Markowski et al. | 60/39.65 |
| 4,662,818 | * | 5/1987 | Hopfensperger et al. | 181/264 |
| 5,133,519 | | 7/1992 | Falco | 244/200 |
| 5,402,964 | * | 4/1995 | Wygnanski | 181/213 |
| 5,803,602 | * | 9/1998 | Eroglu et al. | 138/37 |

FOREIGN PATENT DOCUMENTS

| | | |
|---|---|---|
| 3328973A1 | 2/1985 | (DE) . |
| 0321379A2 | 6/1989 | (EP) . |
| 0410924A2 | 1/1991 | (EP) . |
| 0745809A1 | 12/1996 | (EP) . |
| 1370370 | 1/1988 | (SU) . |

OTHER PUBLICATIONS

"Susceptibility of Turbulent Separating Flow Downstream of a Step to Acoustic Perturbations", Bardakhanov, et al., Fluid Mechanics—Soviet Research, vol. 15, No. 4, Jul.–Aug. 1986, pp. 9–14.

* cited by examiner

*Primary Examiner*—Denise L. Ferensic
*Assistant Examiner*—Gregory A. Wilson
(74) *Attorney, Agent, or Firm*—Burns, Doane, Swecker & Mathis, L.L.P.

(57) ABSTRACT

In heat generators and burners, it is frequently necessary to realize discontinuous cross-sectional expansions of a flow duct. When the flow (U) passes over the step (10) formed in the wall (8) of the flow duct, coherent lateral separation vortices form which are propagated almost undamped downstream of the step and frequently represent the cause of thermo-acoustic vibrations of high amplitude. In accordance with the invention, vortex-generating elements (20) with a lateral pitch dimension (t) are arranged on a line transverse to the main flow (U) a distance (s) upstream of the step (10). Given an expedient selection of the pitch dimension (t), the lateral coherence of the separation vortex is enduringly destroyed.

5 Claims, 4 Drawing Sheets

FLOW DUCT WITH CROSS-SECTIONAL STEP

BACKGROUND OF THE INVENTION

1. Field of the Invention

The present invention relates to a heat generator, into which heat generator a medium flows through a flow duct during operation, the flow duct having at least one discontinuous cross-sectional expansion in the direction of a main flow in such a way that at least one wall bounding the flow duct has a step extending substantially transversely to the main flow direction.

2. Discussion of Background

In combustion technology, it is frequently necessary to operate with widely varying flow velocities. Whereas, for reasons of flame stability, the flow velocity in the heat generators themselves is limited to quite low values, various reasons often make it necessary to provide the inlet flow to the heat generators with high velocities. Because of the demands made on the installation size, it is usually impossible to decelerate the inlet flow to a heat generator in a continuous manner. In consequence, sudden-expansion diffusers with discontinuous cross-sectional expansions are very frequently employed. Although these cause substantial losses in total pressure, they provide a very compact installation. In addition, reverse flows generated in sudden-expansion diffusers are quite desirable, particularly for flame stabilization in heat generators.

However, the vortex structures which occur in sudden-expansion diffusers can also involve extremely damaging consequences under certain circumstances, particularly where the sudden-expansion diffuser is designed simply as a discontinuous cross-sectional expansion of a flow duct. In this case, a step extending substantially transversely to the main flow exists in the flow duct and this step acts as a separation edge for the flow. In the case of a sufficiently large velocity of the incident flow to this edge, periodic separation vortices form which extend parallel to this edge. The coherent vortex structures thus occurring can propagate substantially undamped in the flow direction. Should these periodic vortex structures reach the heat supply location—generally the flame—the periodic pressure fluctuations by which the vortices are manifested are amplified because of the resulting large increase in volume. As a result, thermo-acoustic vibrations of high amplitude occur and these concentrate a high level of vibration energy within a narrow frequency band and have potential for permanently damaging the structure of a heat generator.

It is precisely in modern gas turbine technology—where high flow velocities, high heat release rates and high pressures are present locally—that these thermo-acoustic vibrations play a decisive roll with respect to the reliable operation of the combustion chambers. Mastering them is therefore an essential precondition for the manufacture of gas turbine power stations and combined power stations.

SUMMARY OF THE INVENTION

Accordingly, one object of the invention is to prevent the occurrence of high pressure fluctuations in a narrow frequency range, as discussed above, in a heat generator, into which heat generator a medium flows through a flow duct during operation, the flow duct having at least one discontinuous cross-sectional expansion in the direction of a main flow in such a way that at least one wall bounding the flow duct has a step extending substantially transversely to the main flow direction.

In accordance with the invention, this is achieved by an arrangement wherein a number of vortex-generating elements are arranged upstream of the step, the vortex-generating elements being arranged on a line extending transversely to the main flow direction at a distance from one another with a lateral pitch dimension, and wherein, in order to interfere with coherent periodic separation vortices whose separation frequency is located below a limiting frequency, the lateral pitch dimension is smaller than half the wavelength which is associated with the limiting frequency in the main flow downstream of the step, so that the following condition is satisfied $$t \leq \frac{u_c}{2f_G}$$

in which relationship t represents the lateral pitch dimension of the arrangement of the vortex-generating elements, $u_c$ represents the velocity of the main flow downstream of the step and $f_G$ represents the limiting frequency. Because of the perturbations which these elements introduce into the incident flow, there is no homogeneous flow field at the step so that, at the step, no more separation vortices which have a constant phase position over the whole of the transverse extent of the step can appear. In consequence, gradients in the flow field are induced transversely to the main flow direction so that, on the one hand, the separation vortex is dissipated substantially more rapidly; in addition, in-phase separation vortices no longer reach the flame so that the occurrence of the damaging thermo-acoustic vibrations described at the beginning is effectively prevented.

In addition, it is advantageous for the vortex-generating elements to be arranged no further than 20% of the lateral pitch dimension upstream of the step so that these vortices are not themselves dissipated before reaching the step.

In addition, the height of the vortex-generating elements should not be more than 20% of the pitch dimension so that no excessive pressure losses are caused; the introduction of vortices into the boundary layer is itself sufficient to achieve the desired effect.

It is also advantageous to offset the vortex-generating elements relative to one another by a small distance in the flow direction in order to displace the phase of the vortices relative to one another and further improve the damping.

A preferred geometry of the vortex generators is described in EP 0 745 809 A1, this publication representing a constituent part which is integrated into the present description.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
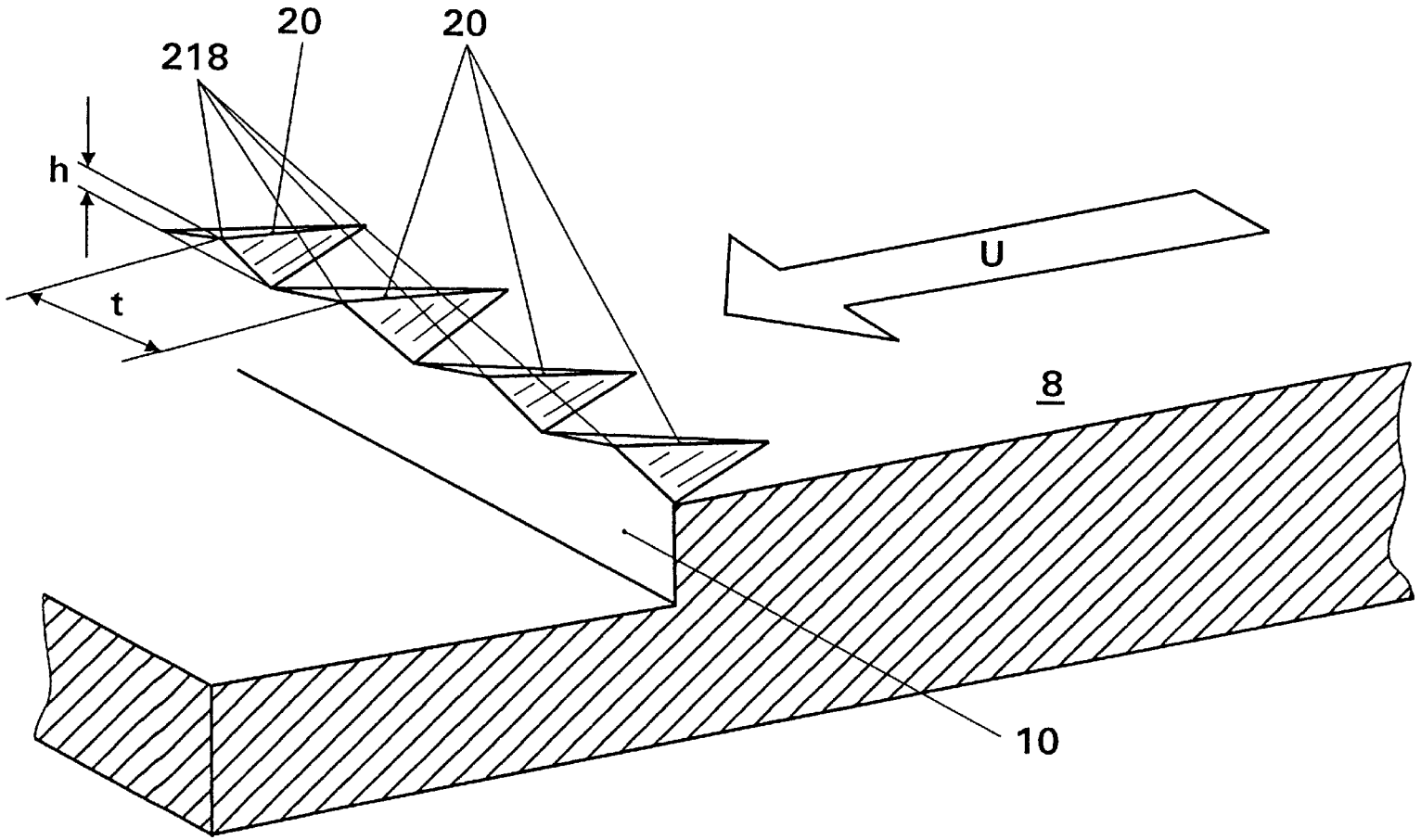
FIG. 1 shows an example of the configuration, according to the invention, of a wall of a flow duct with a step and with vortex-generating elements.

Referring now to the drawings, wherein like reference numerals designate identical or corresponding parts throughout the several views, a flow duct, through which flow occurs in the direction of the arrow designated by U, is shown in FIG. 1. The step 10, of the wall 8, extending substantially transversely to the direction of the main flow U causes a discontinuous cross-sectional expansion of the flow duct, at which expansion flow separation occurs. In this arrangement, the geometry represented as a vertical step is not imperative; it is also quite possible for the step to have a negative or positive undercut, with the installation length representing a limiting factor, particularly in the case of a negative undercut.

In the case of high velocity flow passing over such a step, periodic separations occur. Over a smooth step transverse to the incident flow, in particular, coherent separation vortices form whose phase position is almost constant over the whole of the transverse extent and which, as described at the beginning, propagate almost undamped in the direction of the main flow. If the separation vortices meet at the location of the heat supply, the pressure fluctuations associated with them are amplified and the thermo-acoustic vibrations described at the beginning occur.

The formation of the coherent separation vortices can be avoided by arranging vortex-generating elements 20 upstream of the step on a line extending transverse to the main flow. Separation vortices occur at the tips 218 of the vortex-generating elements 20, which are arranged with a lateral pitch dimension t. These separation vortices avoid the formation of coherent separation vortices whose distance from one another in the main flow downstream of the step is greater than twice the pitch dimension t. Separation frequencies which are larger than a limiting frequency $f_G$, with $f_G$ from the relationship $f_G=u_c/2t$ are therefore effectively damped. In this equation, $u_c$ is the convection velocity of the separation vortices, i.e. the velocity of the main flow downstream of the step.

As may be easily recognized from the physical relationships, an extremely large tolerance can be selected for the pitch dimension—a uniform distance between the vortex-generating elements is not essential to the invention.

The height h of the vortex-generating elements is advantageously selected to be quite small in order not to generate undesirable pressure losses. A dimension of h=0.2 t is fully adequate because, in accordance with the invention, no vortices should be induced in the main flow but only small vortices are generated which interfere with the separation vortices at the step and destroy their lateral coherence. In consequence, it is sufficient to influence a part of the boundary layer for the inventive function according to the invention. The size of the vortex-generating elements can, of course, be located within wide limits and it is not absolutely necessary for the condition set above to be fulfilled in order to satisfy the object set; the vortex-generating elements are then, however, less efficient.

Figure 2:
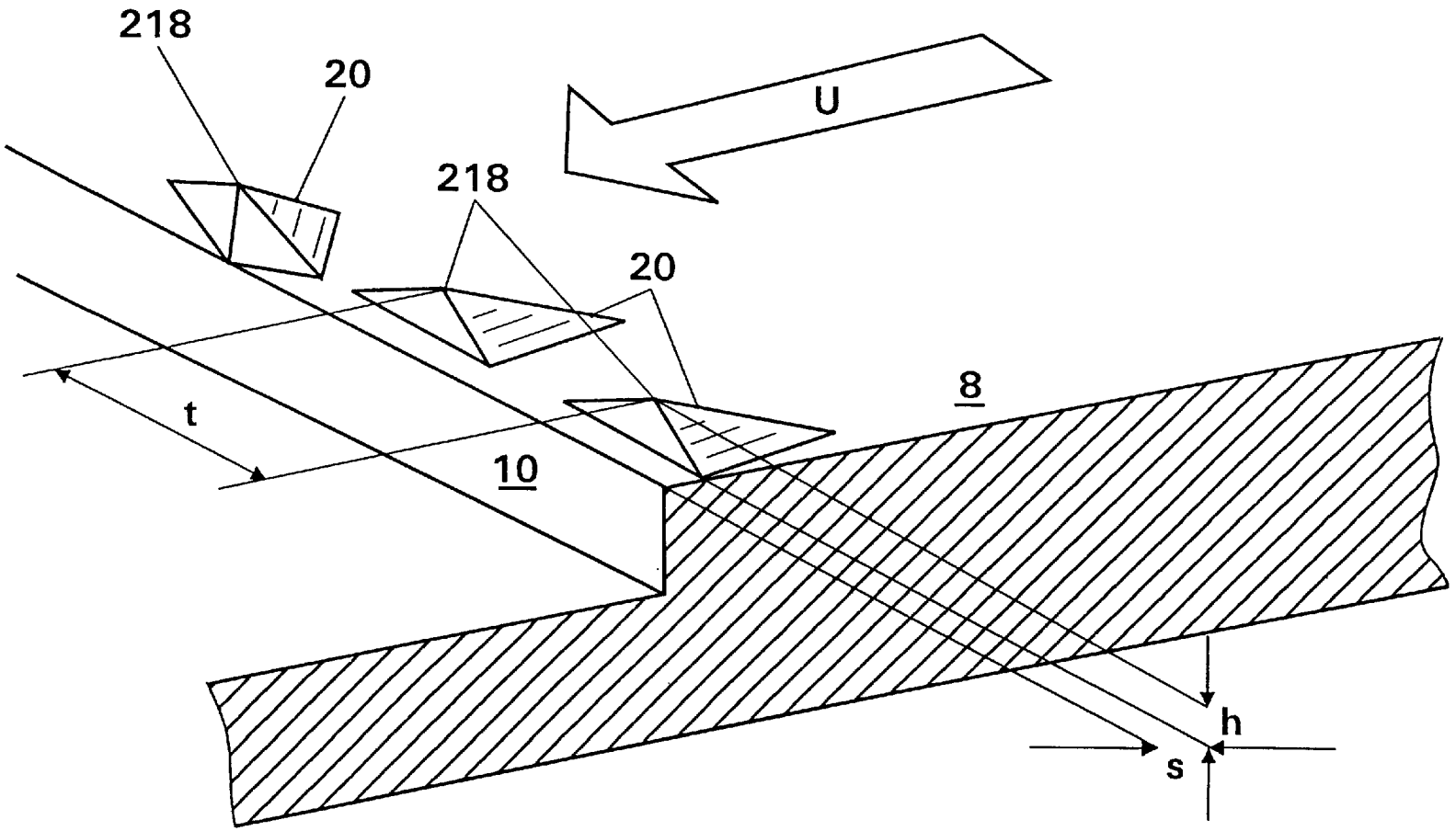
FIG. 2 and 3 show alternative arrangements of vortex-generating elements.

FIG. 2 shows an alternative arrangement of the vortex-generating elements. These do not necessarily have to be arranged directly at the step, as shown in FIG. 1, but their tips 218 may quite well be arranged at a distance s upstream of the step. This distance s certainly does not always have to be the same—different vortex-generating elements can have different positions in the main flow direction. The dimension s for the element located furthest upstream is advantageously, however, not more than 20% of the pitch dimension t.

Figure 3:
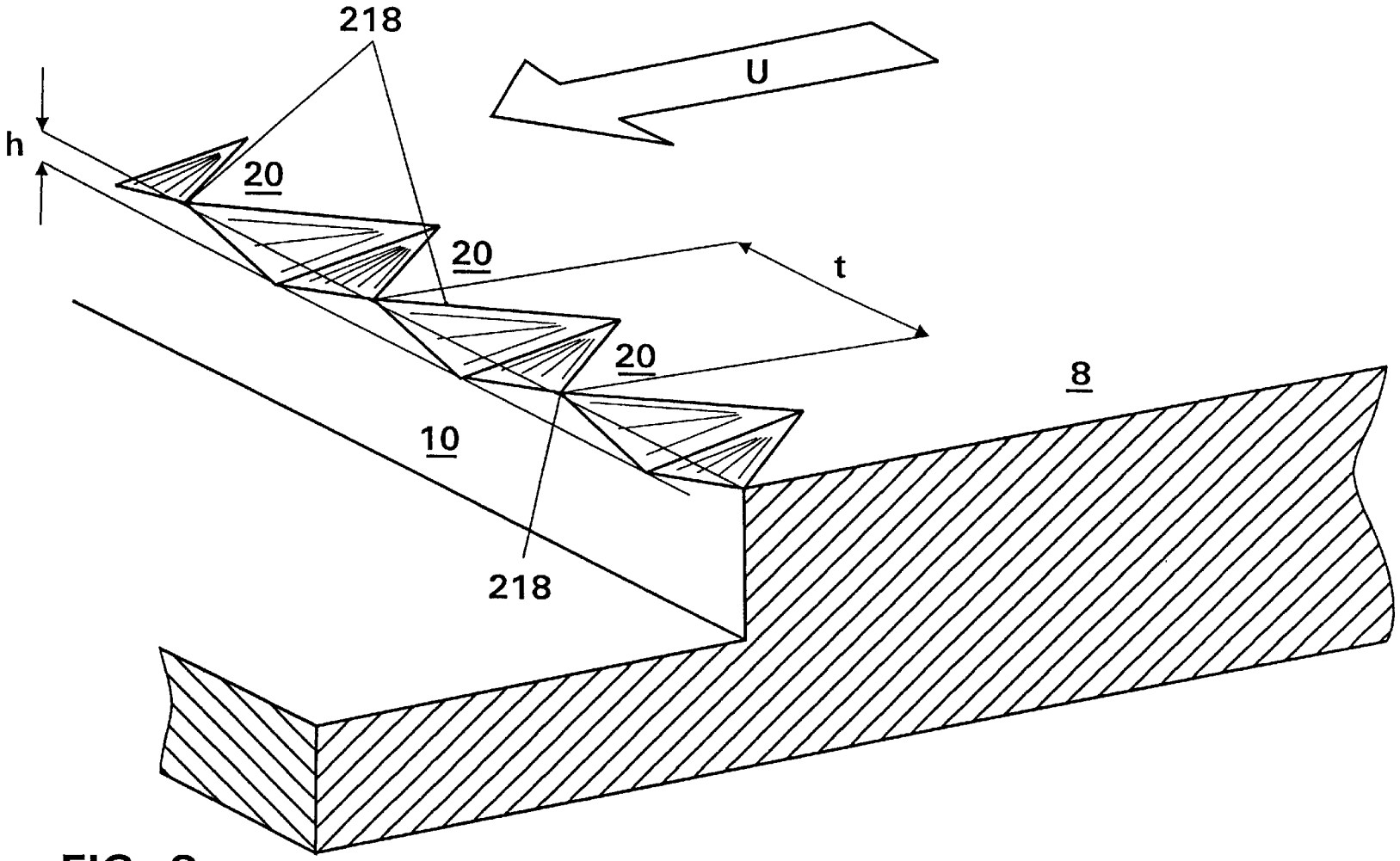

As indicated in FIG. 2, the geometry of the vortex-generating elements is likewise not primarily essential to the invention. As an example, FIG. 3 shows a variant, which is particularly simple with respect to manufacturing technology and in which the notches of depth h are milled into the step at a lateral distance apart of t.

Figure 4:
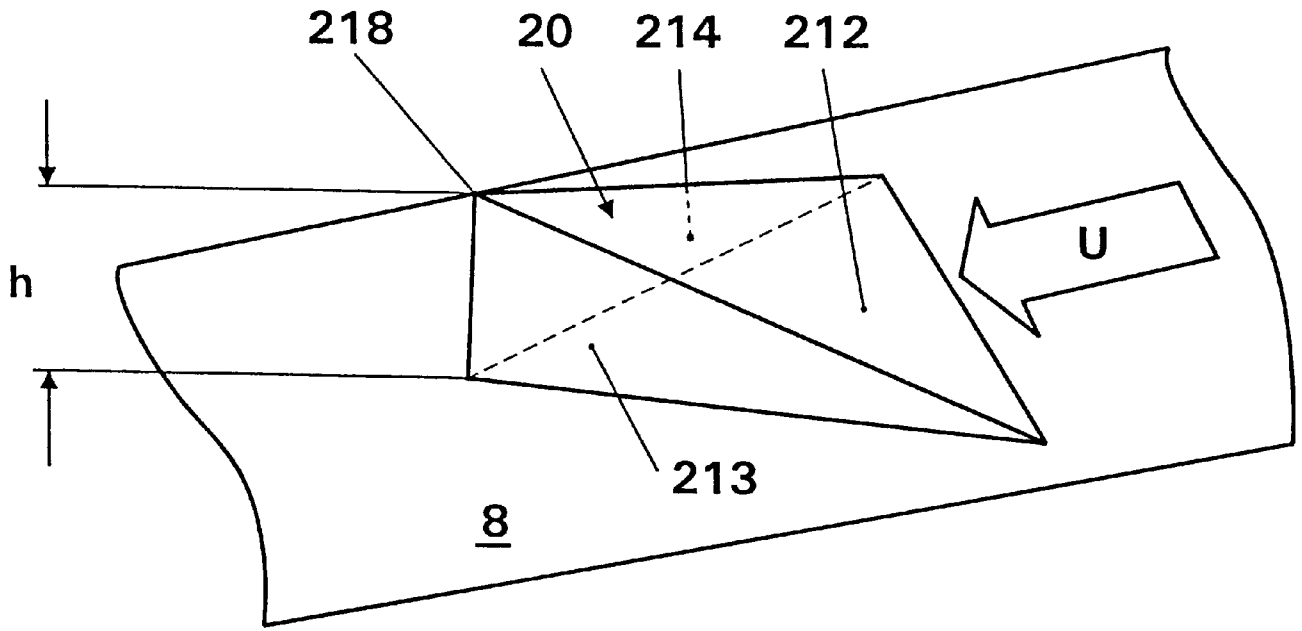
FIG. 4 shows a preferred geometry of the vortex-generating elements.

If, on the other hand, the vortex-generating elements are to have an elevated configuration, the variant illustrated in FIG. 4, and which is known from EP 0 745 809 A1, can be used with advantage. The publication EP 0 745 809 A1 represents a constituent part which is integrated into the present description. In this, a vortex-generating element has three surfaces 212, 213 and 214 around which flow occurs freely, of which surfaces two form the side surfaces 213 and 214 and one forms the top surface 212. The extension of the side surfaces 213 and 214 out of the duct wall 8 increases in the flow direction whereas the distance between the side surfaces decreases and the height reaches a maximum at a downstream point at which the side surfaces meet. The top surface 212 is correspondingly triangular and represents a ramp pointing away from the wall 8 in the flow direction. The maximum extent h of the vortex-generating element away from the wall 8 occurs at a position at which all three surfaces 212, 213 and 214 meet; the tip 218 is defined at this point.

Obviously, numerous modifications and variations of the present invention are possible in light of the above teachings. It is therefore to be understood that within the scope of the appended claims, the invention may be practiced otherwise than as specifically described herein.

What is claimed as new and desired to be second by letters patent of the United States is:

1. A heat generator, into which heat generator a medium flows through a flow duct during operation, the flow duct having at least one discontinuous cross-sectional expansion in the direction of a main flow in such a way that at least one wall bounding the flow duct has a step extending substantially transverse to the main flow direction, wherein a number of vortex-generating elements are arranged upstream of the step, the vortex-generating elements being arranged on a line extending transverse to the main flow direction at a distance from one another with a lateral pitch dimension, and wherein, in order to interfere with coherent periodic separation vortices whose separation frequency is located below a limiting frequency, the lateral pitch dimension is smaller than half the wavelength which is associated with the limiting frequency in the main flow downstream of the step, so that the following condition is satisfied $$t \leq \frac{u_c}{2f_G}$$

in which relationship t represents the lateral pitch dimension of the arrangement of the vortex-generating elements, $u_c$ represents the velocity of the main flow downstream of the step and $f_G$ represents the limiting frequency.

2. The heat generator as claimed in claim 1, wherein the downstream edges of the vortex-generating elements are arranged less than 20% of the lateral pitch dimension upstream of the step.

3. The heat generator as claimed in claim 1, wherein the height of the vortex-generating elements is less than 20% of the lateral pitch dimension.

4. The heat generator as claimed in claim 1, wherein the vortex-generating elements are arranged offset relative to one another in the main flow direction by a dimension which is smaller than 20% of the lateral pitch dimension.

5. The heat generator as claimed in claim 1, wherein a number of milled recesses are machined into the wall bounding the flow duct in order to generate the vortex-generating elements at the location of the step, the distance of the milled recesses from one another corresponding to the lateral pitch dimension.

* * * * *